US005868279A

United States Patent [19]

Powell

[11] Patent Number: 5,868,279

[45] Date of Patent: Feb. 9, 1999

[54] DEVICE FOR DISPENSING LIQUIDS IN A DESIRED RATIO

[76] Inventor: Anthony Powell, Mar-E-Sol, Slade, Northdown Road, Bideford, Devon EX39 3LZ, United Kingdom

[21] Appl. No.: 750,729

[22] PCT Filed: Jun. 16, 1995

[86] PCT No.: PCT/GB95/01409

§ 371 Date: Mar. 11, 1997

§ 102(e) Date: Mar. 11, 1997

[87] PCT Pub. No.: WO95/34501

PCT Pub. Date: Dec. 21, 1995

[30] Foreign Application Priority Data

Jun. 16, 1994 [GB] United Kingdom ..... 9412043

[51] Int. Cl.[6] ..... B67D 5/08

[52] U.S. Cl. ..... 222/59; 222/71; 222/129.1; 73/861.77

[58] Field of Search ..... 222/55, 59, 61, 222/71, 135, 145.5, 399, 129.1, 504; 73/861.77, 861.79, 861.86, 861.87

[56] References Cited

U.S. PATENT DOCUMENTS

| | | | |
|---|---|---|---|
| 4,172,381 | 10/1979 | Aigner | 73/861.77 |
| 4,753,370 | 6/1988 | Rudick | 222/129.1 |
| 4,825,707 | 5/1989 | Rosaen | 73/861.77 |
| 4,964,533 | 10/1990 | Allington et al. | 73/861.77 |
| 5,033,644 | 7/1991 | Tentler | 222/71 |
| 5,054,650 | 10/1991 | Price | 222/71 |
| 5,542,302 | 8/1996 | McMillan et al. | 73/861.77 |

*Primary Examiner*—Philippe Derakshani
*Attorney, Agent, or Firm*—Michael J. Kline

[57] ABSTRACT

The assembly of the present invention comprises a liquid dispensing device having conduit means for delivering liquids from a storage chamber to a mixing chamber, from which the liquid product is dispensed, and valve means incorporated in each conduit. The assembly further comprises a flow meter for each liquid which operates to produce an output signal proportional to the quantity of liquid flowing through the conduit. A control means receives the output signals and operates on detecting that flow of one liquid exceeds a predetermined amount, by closing the flow control valve associated with that liquid. Upon detecting that the proper proportion is achieved, the control means signals the valve to re-open.

13 Claims, 6 Drawing Sheets

DEVICE FOR DISPENSING LIQUIDS IN A DESIRED RATIO

BACKGROUND OF THE INVENTION

1. Field of the Invention

This invention is concerned with liquid dispensers, such as those used to dispense post-mix soft drinks, and which are required to supply a finished product consisting of two liquids mixed at a predetermined ratio.

2. Description of the Related Art

A conventional dispensing device comprises conduit means for connection to storage devices for each of the two liquids, for connection of the storage means to a mixing chamber for the delivery of liquids to the mixing chamber in which the liquids are mixed and from which the mixture is dispensed, valve means being provided for each liquid, and flow control means being provided to control the relative quantities in which said liquids are delivered to the mixing chamber.

A number of situations may occur which cause the ratio in which the proportions in which the two liquids are delivered to the mixing chamber are varied. For example where the storage means is pressurised for the delivery of the liquids to the mixing chamber, pressure applied to the storage means may vary. Additionally, viscosity of the constituents may vary, particularly where one of the liquids is provided by a syrup.

Conventional flow control means operate on a proportional basis, such that the rate of flow of one of the liquids is gradually reduced by an amount proportional to the perceived divergence of the proportions from the desired mixture, so that the flow rates return to correct proportions, the intention being that the rates of flow of the two liquids along the conduits are as desired in the final mixture. Such flow control systems have heretofore proved to be somewhat unsatisfactory, and it is one of the various objects of this invention to provide a liquid dispensing device in which the relative proportions in which the two liquids are dispensed from the mixing device may be maintained with a high degree of accuracy, despite changing external factors.

SUMMARY OF THE INVENTION

According to this invention there is provided a device for dispensing liquids in a desired ratio, the device comprising a) conduit means for the delivery of each liquid from a storage means therefore to a mixing chamber wherein the two liquids are mixed and from which the mixture is dispensed; and b) valve means for each liquid operative in said conduit means;

wherein the device comprises a flow sensing means comprising a flow meter for each liquid operative to produce an output signal proportional to the quantity of liquid flowing through the conduit means, and control means to which the output signals are applied, the control means being operative on detection that flow of one liquid exceeds the other by a predetermined amount, to close the flow control valve associated with said one liquid.

If desired the device may comprise pumps means for each liquid, to pump liquid from the storage means to the mixing chamber under pressure, but more conveniently each liquid is contained in the storage means under pressure.

Conveniently a flow sensing chamber is provided in each of the conduit means, the flow sensing means being located in the flow sensing chamber.

Preferably the flow control meter comprises a flow sensing member rotatable by flow of liquid through the conduit means at a rate proportional to the rate of such flow of liquid, and preferably detection means is provided which is operative to detect the rate of rotation of the flow sensing member.

Conveniently the detection means comprises electromagnetic radiation means. For example, the flow sensing member may comprise one or more magnets, movement of which past a sensor being operative to induce a flow control signal. Alternatively the detection means may comprise a beam of electromagnetic radiation through which the flow sensing member passes as it rotates, breaking of the beam producing a flow control signal the frequency of which indicates the speed at which the flow sensing member is rotating.

Thus desirably the sensing means is operative to produce digital signals the frequency of which being proportional to the rate of flow of liquid sensed by the flow meter.

The digital signals may be used in any convenient manner to signal when an inbalance in flow rate occurs, to interrupt the flow of one liquid to enable the flow of the other liquid to "catch up", but conveniently the digital signals are applied to a counter at which they are compared and upon detection of a comparison result outside predetermined limits, one or other of the valve means is closed to terminate flow of the liquid through the conduit concerned.

Conveniently the digital signals are frequency-divided in accordance with the ratio at which the two liquids are to mixed, the two sets of digital signals being applied to the counter, one being operative to count up, the other being operative to count down, and when the counter reaches a predetermined upper level one of said flow control valves is closed and when the counter reaches a predetermined lower level the other of said flow control valves is closed.

Most conveniently the counter is provided with a median level, and when the counter reduces from said upper predetermined level to the median level said one flow control valve is re-opened, and when the counter climbs from the lower predetermined level to said median level the other of said flow control valves is re-opened.

Most conveniently the flow meter comprises a vaned member mounted for rotation in the flow stream of the liquid in a manner such that the speed of rotation is proportional to the speed of liquid flow along the conduit means.

Advantageously the control means comprises means to disregard a flow signal generated immediately following closure of the associated flow control valve.

In this manner, when under the operation of the flow control means one of the flow control valves is closed, continued rotation of the flow sensing member, under the effect of momentum, will not be recognised as flow of liquid through the conduit means to the mixing chamber.

According to this invention there is also provided a device for mixing two liquids in desired proportions comprising means for delivery of a first liquid to a mixing chamber through a first conduit, said first conduit extending through a first chamber in which a first flow sensing member is mounted for rotation in a manner such that flow of liquid through the first chamber causes the flow sensing member to rotate in dependence on the rate of flow of liquid through the first chamber, and first counter means to produce a signal after a specific quantum of rotation of the first flow sensing member; means for delivery of a second liquid to the mixing chamber, through a second conduit, the second conduit extending through a second chamber in which a second flow sensing member is mounted for rotation in a manner such that flow of liquid through the second chamber causes the second flow sensing member to rotate in dependence upon the rate of flow of liquid through the second chamber, and second counter means to produce a signal after a specific quantum of rotation of the second flow sensing member, and comparator means for determining the existence of an excess of signals from one of said flow sensing members in comparison with the other momentarily to prevent flow of liquid through one of said conduits.

In use, should the pressure of either liquid change, the flow of the liquid will change so that the brix now being delivered will be incorrect. Immediately this starts to happen the signals from the flow measuring devices will no longer balance. When a predetermined maximum error has built up, the electronic circuits are arranged to switch off the valve controlling the liquid that is in excess, until enough of the second liquid has flowed to restore the balance. If the liquid flow is maintained and the pressures continue to be other than correct, the sequence described above will keep repeating. If the device is switched off at any time when an error in the brix is present, the liquid in excess is arranged to be switched off immediately and the other liquid to continue to flow until the measuring devices outputs balance.

By keeping the measured flow increments small and allowing only small-errors to build up, brix can be accurately maintained over a wide range of pressures, provided that the control valves have a rapid response and some electronic compensation is arranged.

In the simplest form the system is for dispensing two liquids, such as soda water and syrup, that is, it is a single product dispenser.

Different manufacturers of syrup require their products to be mixed in different ratios, it is therefore important that the system may be preset in small steps over a wide range of ratios. To achieve this, turbine type transducers are fitted to monitor soda and syrup flow. These are arranged to each produce the same number of pulses for a given quantity of liquid and the number of pulses is desirably at least 25000 per liter of liquid in order to give increments of about 0.04 milliliter. The pulses from the syrup transducer are electronically divided by 10 to produce one pulse out for every 10 produced by the transducer. The pulses from the soda transducer are electronically divided by a two decade divider, presettable in steps of 1 to 99 by two decade switches. Thus, for example, if switches are set to 5 and 0 the number of soda pulses is divided by 50 and if set to 5 and 1 the division would be by 51.

The system can only balance when the number of pulses from syrup and soda are the same. Therefore, in the example above, with decade switches set to 5 and 0, one output pulse would be received after 50 pulses from the soda transducer and one output pulse would be received after 10 from the syrup transducer, representing a syrup to soda ratio of 10 to 50 or 1 to 5. If the decade switches were set to 5 and 1 the syrup to soda ratio would have been 10 to 51 or 1 to 5.1.

Thus, by setting the two decade switches, syrup to soda ratios ranging from 10:1 to 1:9.9 can be achieved in steps of 1. Because the increments from the transducers are about 0.04 ml the actual increments of soda water dispensed at 1:5 brix would be about 2 ml and syrup increments about 0.4 ml for any brix.

From the foregoing, if when a whole drink has been dispensed, the total number of divided syrup pulses is the same as the total number of divided soda pulses, then the brix must be correct. The divided syrup pulses are fed to the UP input and the divided soda pulses to the DOWN input of a 4 bit binary up/down counter. The counter is connected so that when counting up, at maximum count, the flow of syrup is interrupted and when counting down, at minimum count, the flow of soda water is interrupted. The counter is programmed to always be at a count of 8 when dispensing commences and, whilst dispensing, a count of 8 is arranged to switch on both syrup and soda water valves.

When the dispenser is serving, provided that the brix is correct, the incoming pulses to the counter will balance so the count will remain at or near 8. However, if the soda water pressure is reduced or the syrup pressure increased, there will be an excess of syrup so the count will rise and if the excess continues the maximum count of 15 will be reached inhibiting the syrup flow until the count once again drops to 8, when the flow will restart.

Similarly, if the syrup pressure is reduced or the soda water pressure is increased, there will be an excess of soda water so the count will fall and if the condition persists, the minimum count of 0 will be reached and soda water will be inhibited until once again the count rises to 8.

The foregoing will keep repeating whilst the device is dispensing, however, when the product flow is off, the circuit is arranged so that the liquid in excess will cease to flow after the next incoming pulse but the flow of the other liquid will continue until the count returns to 8. That is, for an excess of soda water the counter will count up to 8 and for an excess of syrup down to 8.

The invention may be used to control flow by switching conventional solenoid valves but because these are not instantaneous in operation, flow will continue for a short time after switching off. In addition, the transducer wheels may continue to rotate for a time after the valves have closed. Thus, for accurate flow measurement, the signals from the transducers must be inhibited at the instant of valve closure and the counter must be capable of registering the over count that must occur.

Valve closure can be detected, for example, by optical or mechanical switching and approximated by timing, however, the moment of closure can be conveniently and accurately detected by sensing the DC voltage generated across the solenoid coil as the armature moves outwards after switching off. This voltage, although falling, will persist until the armature stops moving and can be readily detected. If the armature is directly attached to the valve, its stopping will coincide with closure, if indirectly connected, careful adjustment can make coincidence very close. The generated voltage is independent of any ringing that may occur and if the solenoid is energised with DC, its polarity will be constant. Conversely, if the solenoid is energised with AC, its polarity will be determined by whether switching occurs during a positive or negative half cycle. A practical example of the invention described hereafter, makes use of this generated voltage to detect valve closure.

The invention is also ideal for multi-flavour dispensers and could provide a very economical solution where different flavours are dispensed through a single outlet. In this instance, only one drink can be dispensed at a time, so only one soda water transducer and one electronic circuit would be required, a transducer and a solenoid valve would be required for each flavour and these would be switched in as required.

BRIEF DESCRIPTION OF THE DRAWINGS

There will now be given a detailed description, to be read with reference to the accompanying drawings, of a liquid dispenser which is a preferred embodiment of the invention, having been selected for the purposes of illustrating the invention by way of example.

In the accompanying drawings.

DETAILED DESCRIPTION OF THE PREFERRED EMBODIMENTS

Figure 1:
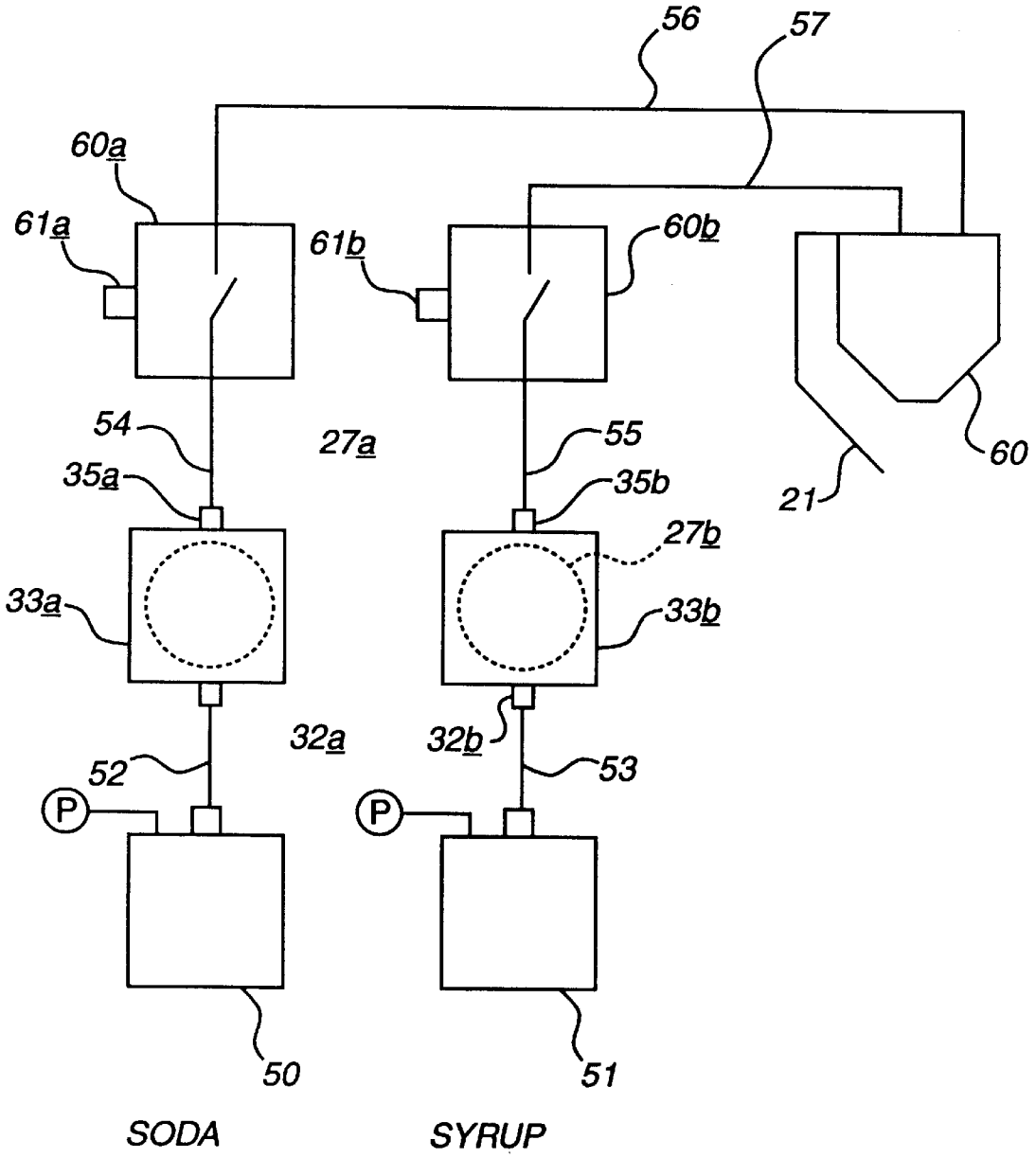
FIG. 1 is a schematic view of the dispenser which is the preferred embodiment of the invention.

The dispensing device which is the preferred embodiment of this invention is for dispensing a mixture of two liquids, conventionally soda water and syrup, but can of course be used for the dispensing of a mixture of other liquids. The device, shown schematically in FIG. 1, comprises conduit means for connection to two storage tanks 50, 51 for the two liquids, said storage tanks conveniently being pressurised by carbon dioxide cylinders P.

The conduits extend from the storage tanks to a mixing chamber 60, within which the liquids are mixed and from which the mixture is dispensed through an outlet thereof, said conduits comprising a first section 52, 53 which in use are connected to the storage tanks and which extend to inlet ports 32*a*, 32*b* of flow control chamber 33*a*, 33*b*. Further sections 54, 55 of the conduits extend from outlets 35 of the flow control chambers to respective valve chambers 60*a*, 60*b* wherein are located solenoid-operated valves 61*a*, 61*b* under the control of a solenoid assembly 23, and from the valve chambers conduit sections 56, 57 extend to the mixing chamber 60.

Located in each flow sensing chamber 33*a*, 33*b* is a flow sensing member 27*a*, 27*b* which is caused by flow of fluid through the conduit means to rotate. The rotation of the flow sensing member is counted, and the comparative count results are input to a control means, which is operative to control the solenoid valves 61*a*, 61*b* to reduce or completely close momentarily that solenoid which is associated with a conduit, flow through which appears to be excessive.

Figure 5:
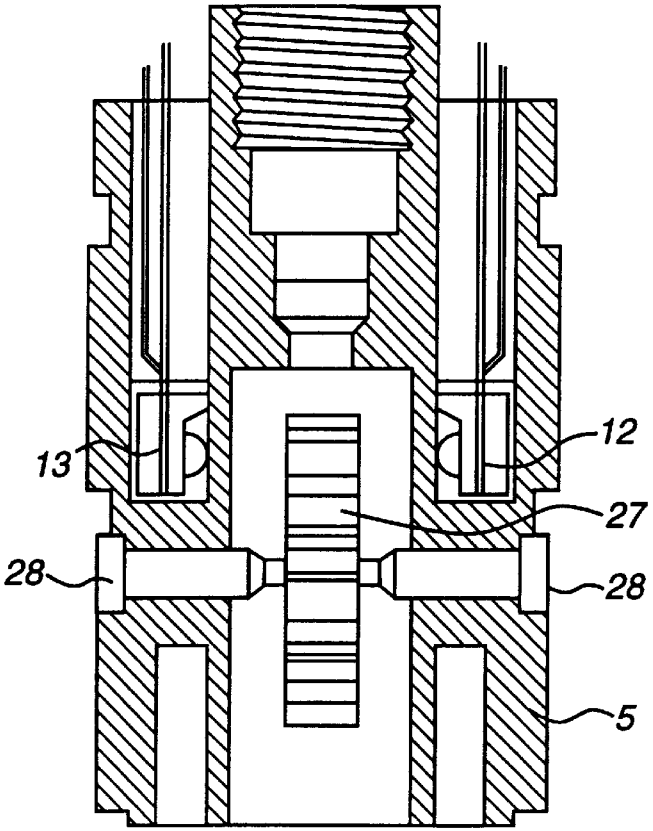
FIGS. 4 and 5 are respectively side and front sectional views showing a flow control chamber of the preferred embodiment.
Figure 4:
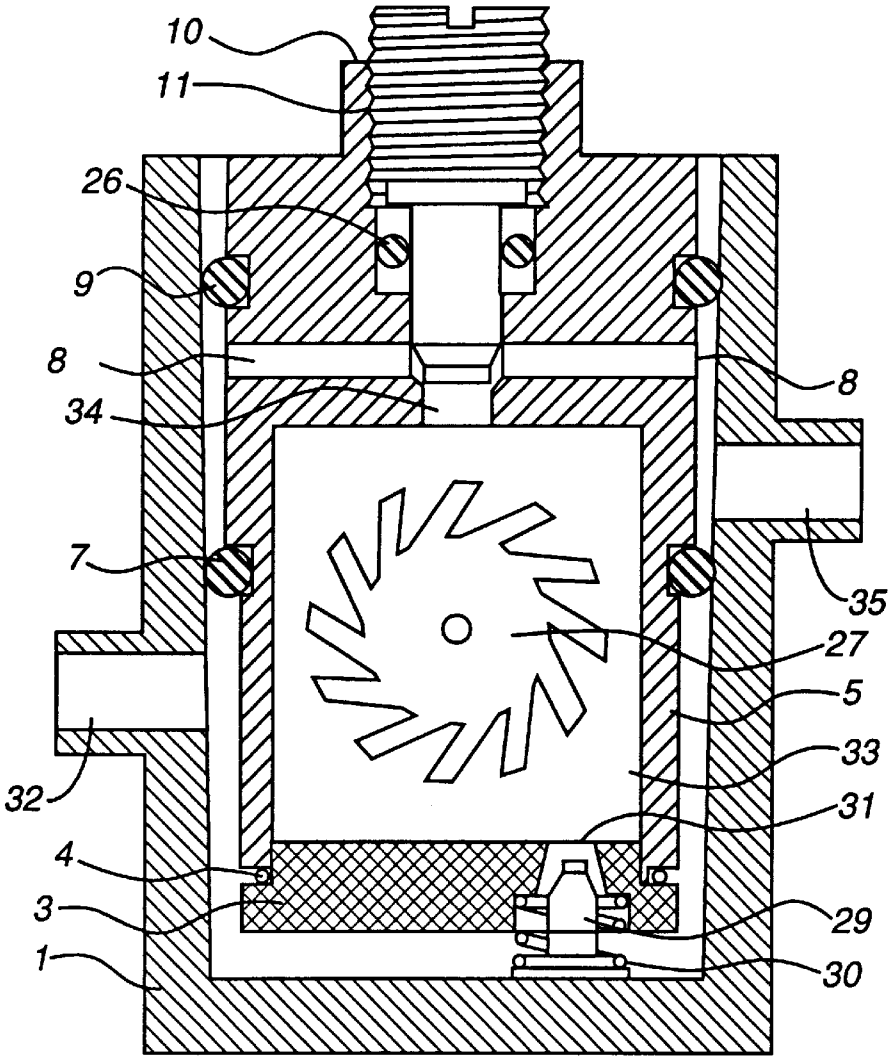

With reference to FIGS. 4 and 5, the flow sensing assembly comprises a body 5, toothed wheel 27, two bearing pins 28, flow control screw 11 and sealing 'O' ring 26, upper body 'O' ring 9, lower body 'O' ring 7, base assembly 3 comprising jet 31, spear 29 and spring 30, and base sealing 'O' ring 4.

The infra red emitter 13 and the infra red detector 12 are attached to the encapsulated Brix Setting P.C.B. 14, (FIG. 1) and are in place only when the system is assembled.

Referring to FIG. 4, liquid flowing into the inlet 32 cannot pass the lower body 'O' ring 7 so flows around the lower half of the body 5 and under the base assembly 3, entering the chamber 33 via the jet 31. The liquid fills the chamber 33 but the flow from the jet 31 impinges on the toothed wheel 27 causing it to rotate. The liquid escapes through the port 34 at a rate determined by the setting of the flow control screw 11, into the two slots 8. The liquid cannot rise above the upper body 'O' ring 9 or below the lower body 'O' ring 7, so it flows around the upper half of the body 5 into the outlet 35.

Referring to FIG. 5, the infra red beam from the emitter 13 is interrupted by the toothed wheel 27 as it rotates.

The interrupted beam is received by the infra red detector 12 which produces electrical pulses at a rate determined by the flow rate of the liquid.

For the system to function satisfactorily, the two flow sensing assemblies must have equal sensitivity, and to ensure this, a means of sensitivity adjustment is incorporated. This functions as follows:

Referring to the base assembly 3, (FIG. 4), a spear 29 is held against the bottom of the valve base 1 by a spring 30. With the flow sensing assembly in the position shown, the spear 29 has little effect upon the jet 31, however, by moving the flow sensing assembly downwards, the spear enters the jet reducing its effective size increasing the velocity of the liquid impinging on the toothed wheel 27. This has the effect of increasing the wheel's R.P.M. for a given liquid flow. The flow sensing assemblies are moved downwards by exerting pressure on the shoulder 10.

Figure 3:
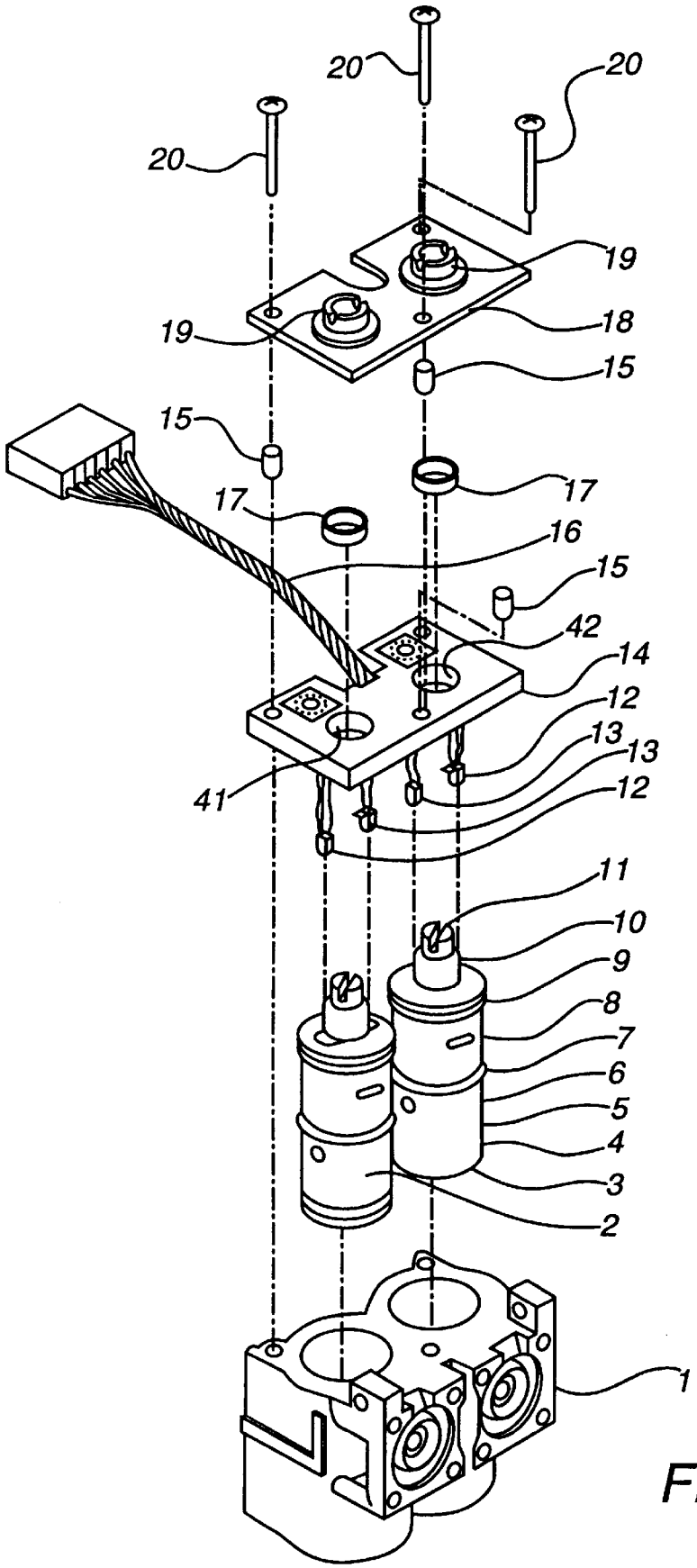
FIG. 3 is an exploded perspective view of the flow control system of the preferred embodiment.

Referring to FIG. 3, the Brix Setting P.C.B. 14 is mounted directly on the flow sensing assemblies so that the flow control screws 11 and the shoulder 10 enter the large holes 41 and 42. The collars 17 also enter the large holes and rest on the shoulder 10. The retaining plate 18 rests on the three spacers 15 which pass through the registering holes in the Brix Setting P.C.B. assembly 14, to rest on the tapped holes in the valve base 1. The fixing screws 20 pass through the retaining plate 18 and spacers 15 to enter the tapped holes in the valve base 1. This holds the retaining plate rigid but does allow some slight movement by the Brix Setting P.C.B. 14. The two hollow sensitivity adjusting screws 19 in the retaining plate 18 allow access to the two flow control screws 11 and bear upon the collars 17 so that when they are screwed down, the pressure exerted on the shoulders 10 causes the flow sensing assemblies 2 to move downwards, causing the spear 29 to enter the jet 29. When the sensitivity adjusting screws are unscrewed the liquid pressure within the valve base 1 moves the transducers upwards.

Figure 2:
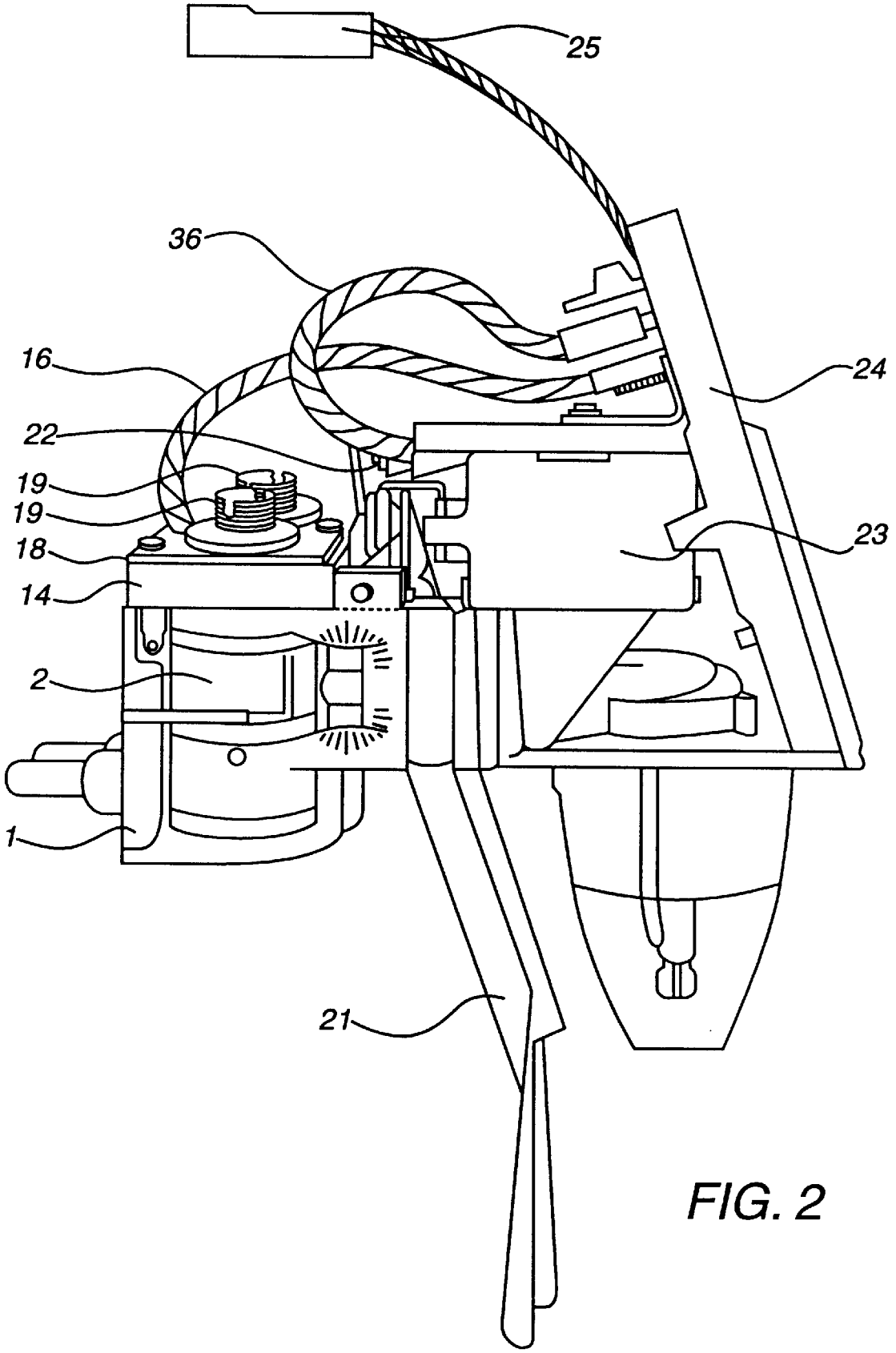
FIG. 2 is a side elevation of the preferred embodiment, showing flow control valves and a mixing chamber.

Referring to FIG. 2, the activating lever 21 operates the activating switch 22 when a drink is required. The solenoid assembly 23 wiring and the activating switch 22 wiring have been modified from standard to make them compatible with the Balancing and Switching P.C.B. 24 into which they are directly connected by the five way free socket assembly 36. The Brix Setting P.C.B. 14 is directly connected to the Balancing and Switching P.C.B. by the six way free socket assembly 16. The 24 volt AC power supply is connected to the Balancing and Switching P.C.B. via the two pin assembly 25.

Figure 6:
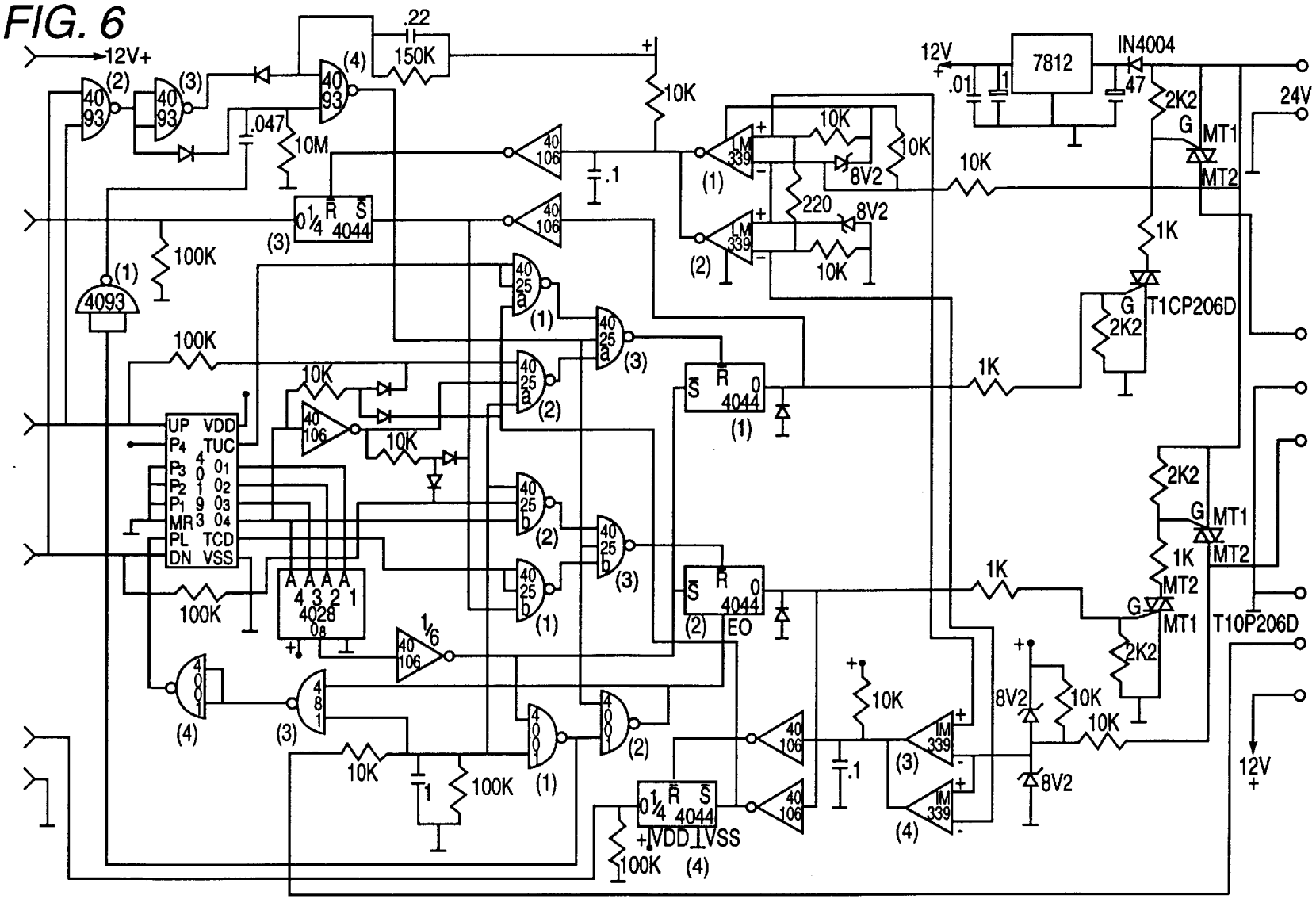
FIGS. 6 and 7 are circuit diagrams of electrical components of the flow control system.
Figure 7:
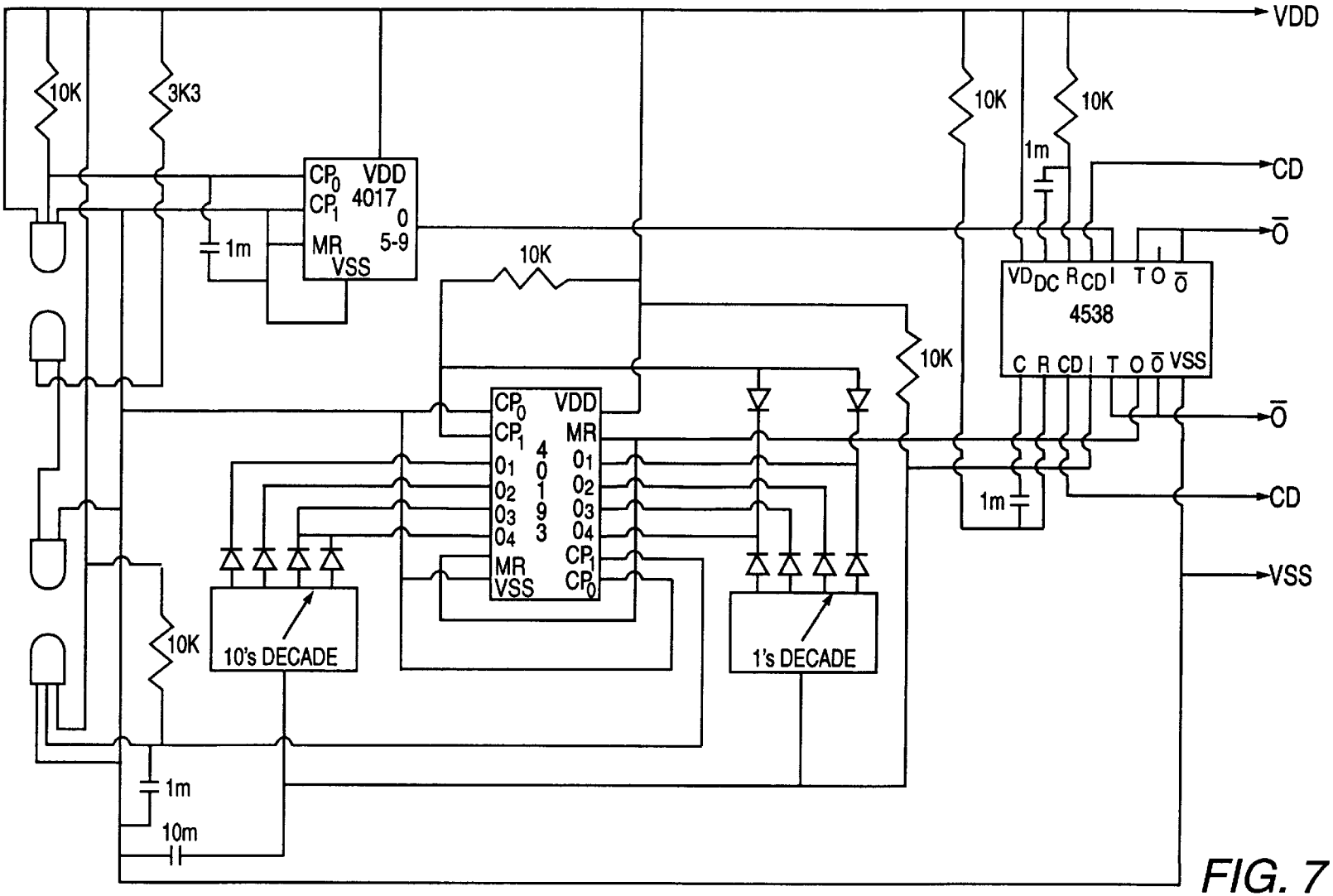

For convenience, the electronic circuit has been assembled on two separate encapsulated printed circuit boards, namely, the Brix Setting P.C.B. 14 mounted on top of the flow sensing assemblies and shown in FIG. 6 and the Balancing and Switching P.C.B. 24 mounted directly in front of the solenoid assembly and shown in FIG. 7.

Referring to the Brix Setting P.C.B. circuit the mode of operation is as follows:

The rotating toothed wheel in the syrup flow sensing assembly interrupts the beam between the infra red emitter and detector. The pulses produced are fed into the decade counter IC 4017, this is connected so that every tenth pulse triggers. one of the two monostables in IC 4538. The output and clear direct of this monostable connect to two ways of a six way free socket, which plugs into the Balancing and Switching P.C.B.

The rotating toothed wheel in the soda water flow sensing assembly interrupts the beam between the infra red emitter and detector. The pulses produced are fed into the input of one of the two BCD counters in IC 4518. This is the units counter and the required output count is set by the unit's decade switch. Every count of ten is arranged to trigger the second BCD counter in IC 4518. This now becomes the tens counter and the required output count is set by the ten's decade switch. The outputs from the two decade switches are commoned and are normally held low by the accompanying diodes, however, when the number set by the decade switches is reached the output will go high, triggering the second monostable in IC 4538. The output from this resets both counters to zero, ready to count further incoming pulses. The output and clear direct of this second monostable also connect to two ways of the six way free socket.

The power supply for the components on this P.C.B. is derived from the Balancing and Switching P.C.B. and account for the remaining two ways on the six way free socket, marked Vdd and Vss on the circuit diagram.

Referring to the Balancing and Switching P.C.B. circuit drawing, the mode of operation is as follows:

The syrup and soda water outputs from the dual monostable on the Brix Setting P.C.B. are connected to drive the UP and DOWN inputs of binary counter IC 40193, which is programmed to commence counting at 8, when the parallel load input PL changes from low to high. Decoder IC 4028 is connected to the outputs of the counter, the $0_8$ output of this is connected, via an inverter 1/6 IC 40106, to the set S inputs of latches IC 4044-1 and 4044-2. Latch 4044-1 drives the syrup solenoid valve switching circuit and latch 4044-2 drives the soda valve switching circuit.

The reset R input of each latch is connected to a gating arrangement, IC 4025(*a*)-1,2,3&4 for syrup and IC 4025(*b*)-1,2,3&4 for soda water, which determine whether the latch outputs are high or low.

The latches IC 4044-1 and IC 4044-2 each drive a TICP206D triac which in turn drive the TIC206 solenoid switching triacs.

After attenuation and limiting by zener diodes, any voltages appearing across the syrup solenoid coil are fed to comparators 1 and 2 of quad comparator IC LM339, the commoned outputs of which will be driven low. The commoned comparator outputs are inverted by 1/6 IC 40106 and connected to the reset R of one of the remaining latches IC 4044-3. The set S input is connected via inverter 1/6 IC 40106 to the output of syrup latch IC 4044-1. The output of latch IC 4044-3 connects to the syrup clear direct CD on the Brix Setting P.C.B. This arrangement ensures that pulses entering the UP input of IC 40193 are inhibited unless there is a voltage appearing across the syrup solenoid coil.

Similarly, after attenuation and limiting, voltages, appearing across the soda water solenoid coil, keep the commoned output of comparators IC LM339-3 and LM339-4 low. This commoned output is inverted by 1/6 IC 40106 and connected to the reset R of the fourth latch IC 4044-4 whose set input S is connected via inverter 1/6 IC 40106 to the output of the soda water latch IC 4044-2. The output of latch IC 4044-4 connects to the soda water clear direct CD on the Brix Setting P.C.B. This arrangement ensures the pulses entering the DOWN input of IC 40193 are inhibited unless there is a voltage appearing across the soda water solenoid coil.

Input pulses to the counter IC 40193 must arrive within prescribed time limits, that is not too fast or too slow. The quad schmitt trigger IC 4093 is connected so that pulses incoming at an acceptable rate maintain the output of IC 4093-4 low and high if the rate is unacceptable. If the output of IC 4093-4 is high, gating ensures that dispensing ceases, however, when the activating switch initiates dispense, there are no incoming pulses but the output of IC 4093-1 is driven high and due to long time constant of the circuit, 0.047 mf capacitor and 10 m resistor, the output of IC 4093-4 is held low long enough to ensure that dispensing starts and incoming pulses are generated to keep it low.

The circuit operates from a 24 volt AC supply, rectification is half wave by diode 1N4004. A 12 volt DC rail is provided by the 47 mf reservoir capacitor and IC7812 voltage regulator.

The following, with special reference to gating, explains how the aforementioned circuits collectively enable the system to function. Assuming that the 24 volt AC power supply is on and the activating switch off (that is COMMON to Vss.), the output enable EO of the latches IC4044 is low so the solenoid valve switching circuits are inoperative and incoming pulses from the transducers are inhibited, also the resets R of all IC4044 latches are low.

With the activating switch on (that is COMMON to Vdd), the counter IC40193 presets to a count of 8, this is necessary because, at power switch "on", the count is not determined. This count of 8 is decoded by IC4028 making it's $0_8$ output high, after inversion by 1/6 IC40106 driving the set S inputs of latches IC4044-1 and 4044-2 low. The output of IC4093-4 instantly goes low, the count up output $TC_U$ and the count down output $TC_D$ of IC40193 are both high holding the outputs of IC4025(*a*)-1 and IC4025(*b*)-1 low. The high on the COMMON of the activating switch drives one input of both IC4025(*a*)-2 and IC4025(*b*)-2 high, guaranteeing their low outputs. So that at this instant the resets R of latches IC4044-1 and IC4044-2 are held high. The switch also drives the output enable EO of IC4044 high so the system can become active. The outputs of latches IC4044-1 and IC4044-2 go high to switch on the triacs driving the syrup and soda water solenoid valves. The voltages across the solenoid coils activate the LM339 comparators, who, in turn, cause the outputs of latches IC4044-3 and IC4044-4 to go high, enabling the pulses to the UP and DOWN inputs of counter IC40193. Counting now commences and provided that the pulses arrive at acceptable rate, IC4093-4 outputs will remain low, allowing dispensing to take place.

If the flow rates are correct, up and down pulses will arrive at the same rate, so the count will remain at or near 8. Should up and down pulses coincide exactly, they will be ignored by the counter but this is of no consequence as the balance would not be upset.

With incorrect flow rates, the count will rise above 8 if syrup is in excess and will fall below 8 if soda water is in excess. If the count rises to 15, due to excess syrup, the count up output $TC_U$ will go low, driving the output of IC4025(*a*)-1 high making the output of IC4025(*a*)-3 low, resetting latch IC4044-1 so that its output goes low switching off the syrup solenoid valve. The voltage generated as the solenoid armature is released holds latch IC4044-3 output high so that counting continues until the armature ceases to move and the valve is closed. Because 15 is the maximum count the additional up counting will cause the count to go 0,1,2,3 etc. With syrup switched off and soda water flowing, the count will fall but at 0 the count output $TC_D$ will go low, however, the soda water flow will be maintained because the second input to IC4025(*b*)-1 will be high coming from the inverted output of the syrup switching latch IC4044-1, allowing the count to fall to 8.

Similarly, if soda water is in excess, the count will fall and when 0 is reached the count down output $TC_D$ will go low driving IC4025(*b*)-1 output high making IC4025(*b*)-3 output low causing latch IC4044-2 to switch off the soda water solenoid valve. Again an over count will occur and in this instance the counts below 0 will be 15, 14, 13, 14 etc. With soda water switched off and syrup flowing, up counting will occur and at the count of 15 the count up output $TC_U$ will go low but the syrup flow will be unaffected because the second input to IC4025(*a*)-1 is connected to the inverted output of the soda water switching latch IC4044-2. So courting is allowed to proceed upwards to a count of 8.

At the count of 8 the $0_8$ output of decoder IC4028 goes high and after inversion by 1/6 IC40106 drives the set S inputs of the two switching latches IC4044-1 and IC4044-2 low to ensure that both the syrup and soda water solenoid valves are switched on.

When the flow rates are incorrect, the foregoing will repeat at a rate determined by the magnitude of the flow rate error, while the activating switch remains on.

If the flow rates are correct or very nearly correct, the count may never reach a maximum or minimum, so both syrup and soda water continue to flow throughout the time the activating switch is on.

At switch off the permanent high is removed from the inputs of NOR gate IC4025(*a*)-2 and IC4025(*b*)-2 so that they may be controlled by the remaining two inputs. All the other circuits controlled by the activating switch are held on by the inverted $0_8$ output of decoder IC4028,(NOR gates IC4001-1,2,3 & 4 achieve this), provided that the count is not at 8. If at this time syrup is in excess but still flowing, the count must be above 8, therefore the $0_4$ output of counter IC40193 will be high, so that after inversion by 1/6 IC40106 the input to IC4025(*a*)-2 is driven low so that its output is now only held low by the normally high count up UP input of IC40193. The next incoming pulse to the count up input will drive it low forcing the output of IC4025(*a*)-2 high, the output of IC4025(*a*)-3 low to make switching latch IC4044-1 switch off the flow of syrup. The soda water continuing to flow until the count drops to 8. If at the instant of switch off, syrup is in excess and is switched off and an over count is present, the count will be below 8 so the $0_4$ output of IC40193 will be low instead of high, as a result the output of IC4025(*b*)-2 will not be maintained low when an incoming pulse drives the count input of IC40193 low. Thus the soda water would be switched off before balance was reached at a count of 8. To overcome this, a diode gating circuit has been incorporated to hold the pulsed input of IC4025(*b*)-2 high when syrup is switched off and an up over count is present.

If at the instant of switch off soda water is in excess but still flowing, the count must be below 8, therefore the $0_4$ output of IC40193 will be low driving the second input of IC4025(*b*)-2 low so that its output is now only held low by the normally high state of IC40193's count down input. The next incoming pulse to this count down input will drive it low so the output of IC4025(*b*)-2 will be driven high, the output of IC4025(*b*)-3 low to make the switching latch IC4044-2 switch off the flow of soda water. The syrup continuing to flow until the count rises to 8.

If at the instant of switch off soda water is in excess and has stopped flowing and an over count is present, circuitry similar to that described for a syrup over count ensures that the flow of syrup cannot be stopped before balance is reached at a count of 8.

When the count arrives at 8, after the activating switch is off, the output of IC4001-1 goes high and the output of IC1093-4 also goes high to make the output of IC4001-2 low, this takes the output enable EO of the IC4044 latches low, effectively switching off and locking off both syrup and soda water solenoid valves until the system is once again activated.

Whilst the invention has been described above in relation to the control system causing a cessation of flow through one of the conduits, if desired the flow control system may cause the appropriate valve to adopt an alternative position in which a significantly reduced flow of liquid through the conduit is permitted. It will of course be appreciated that the alternative position must provide such a significantly reduced flow rate, that there will be a tendency for the count to be corrected, prior to resumption of normal operation.

The features disclosed in the foregoing description, or the following claims, or the accompanying drawings, expressed in their specific forms or in terms of a means for performing the disclosed functin, or a method or process for attaining the disclosed result, as appropriate, may, separately or in any combination of such features, be utilised for realizing the invention in diverse forms thereof.

I claim:

1. A device for dispensing two liquids in a desired ratio, comprising a) conduit means (52–57) for connection to a storage means (50, 51) for each of the two liquids, for the delivery of liquid to a mixing chamber (60) wherein the two liquids are mixed and from which the mixture is dispensed;

b) valve means (60, 61) for each liquid operative in said conduit means;

c) flow sensing means comprising a flow meter (27, 33) for each liquid located in the conduit means and which is operative to produce an output signal proportional to the quantity of liquid flowing through the conduit means; and d) control means (23) to which the output signals are applied, wherein the control means (23) is operative on detection during operation of the device that flow of one liquid exceeds that of another by more than a predetermined amount, to close the flow control valve (61) associated with said one liquid, and opening said flow control valve on detection that the desired ratio has been substantially restored.

2. A device according to claim 1 comprising a flow chamber (33) for each liquid located in the conduit means, within which chamber the flow sensing means (27) is located.

3. A device according to claim 2 comprising a flow sensing member (27) rotatable in each flow chamber (33) by flow of liquid through the conduit means at a rate proportional to the rate of such flow of liquid.

4. A device according to claim 3 wherein the flow sensing means comprises detection means (12, 13) operative to detect the rate of rotation of said flow sensing member (27).

5. A device according to claim 1 wherein the control means is operative to produce digital signals the frequency of which is proportional to the rate of flow of liquid as sensed by the flow sensing means (12, 13, 27).

6. A device according to claim 5 wherein the digital signals are applied to a counter at which they are compared and upon detection of a comparison result outside predetermined limits, one of the valve means is closed.

7. A device according to claim 5 wherein the digital signals are frequency divided in accordance with the ratio of the two liquids, both sets of digital signals being applied to a counter, one set being operative to cause the counter to count up, the other set being operative to cause the counter to count down, and wherein when the counter reaches a predetermined upper level one of said flow control valves is closed and when the counter reaches a predetermined lower level, the other of said flow control valves is closed.

8. A device according to claim 1 comprising means operative to cause an output signal generated immediately subsequent to closure of a flow control valve (61) to be disregarded.

9. A device according to claim 3 wherein the flow sensing member comprises a vaned member (27) mounted for rotation in the flow stream of the liquid in a manner such that the speed of rotation is proportional to the speed of liquid flow along the conduit means.

10. A device according to claim 9 comprising means (18, 19) to adjust the response of the flow sensing member to flow of liquid through the conduit means.

11. A dispensing device according to claim 1 comprising adjustment means in the conduit means to adjust the relative rates of flow of liquids through the conduit means to approximately desired values.

12. A method of mixing two liquids in desired proportions using a device having a first conduit (52, 54, 56) for delivery of a first liquid to a mixing chamber (60), said first conduit extending through a first chamber (33*a*) in which a first flow sensing member (27*a*) is mounted for rotation in a manner such that flow of liquid through the first chamber causes the flow sensing member to rotate in dependence on the rate of flow of liquid through the first chamber, and first counter means (IC40193) to produce a signal after a specific quantum of rotation of the first flow sensing member; a second conduit (53, 56, 57) for delivery of a second liquid to the mixing chamber, the second conduit extending through a second chamber (33*b*) in which a second flow sensing member (27*b*) is mounted for rotation in a manner such that flow of liquid through the second chamber causes the second flow sensing member to rotate in dependence upon the rate of flow liquid through the second chamber, and second counter means (IC40193) to produce a signal after a specific quantum of rotation of the second flow control member; and comparator means (IC LM339) for determining the existence of an excess of signals from one of said flow sensing members in comparison with the other momentarily to prevent flow of liquid through one of said conduits, comprising a) comparing the signals from the two counters to determine whether there is an excess of one of the two liquids;

b) adjusting to reduce the flow of any said excess liquid;

c) permitting the flow of previously determined excess liquid, after the signals from the two counters indicate desired levels.

13. A device according to claim 12 wherein said flow of liquid is again permitted when a sufficient count has been obtained from the other flow sensing member to bring the ratio in which the two liquids are present in the mixing chamber substantially in accordance with the desired proportions.

* * * * *